United States Patent [19]

Knudsen et al.

[11] Patent Number: 4,913,773

[45] Date of Patent: Apr. 3, 1990

[54] METHOD OF MANUFACTURE OF PAPERBOARD

[75] Inventors: Keith W. Knudsen; Thomas J. Ziolkowski, both of Neenah; William C. Bean, Larsen, all of Wis.

[73] Assignee: James River-Norwalk, Inc., S. Norwalk, Conn.

[21] Appl. No.: 313,322

[22] Filed: Feb. 17, 1989

Related U.S. Application Data

[63] Continuation of Ser. No. 3,200, Jan. 14, 1987, abandoned, which is a continuation of Ser. No. 727,353, Apr. 25, 1985, abandoned.

[51] Int. Cl.[4] ..... D21H 1/02

[52] U.S. Cl. ..... 162/129; 162/130; 162/133; 162/149

[58] Field of Search ..... 162/9, 123, 125, 129, 162/130, 132, 133, 100, 182, 149

[56] References Cited

U.S. PATENT DOCUMENTS

| | | | |
|---|---|---|---|
| 260,680 | 6/1882 | Heath | 162/129 |
| 3,994,771 | 11/1976 | Morgan et al. | 162/123 |
| 4,036,679 | 7/1977 | Back et al. | 162/9 |
| 4,102,737 | 7/1978 | Morton | 162/113 |
| 4,166,001 | 8/1979 | Dunning et al. | 162/129 |
| 4,225,382 | 9/1980 | Kearney et al. | 162/111 |
| 4,227,964 | 10/1980 | Kerr et al. | 162/9 |
| 4,344,818 | 8/1982 | Nuttall et al. | 162/146 |
| 4,409,065 | 10/1983 | Kasser | 162/9 |
| 4,431,479 | 2/1984 | Barbe et al. | 162/9 |
| 4,488,932 | 12/1984 | Eber et al. | 162/9 |

FOREIGN PATENT DOCUMENTS

| | | | |
|---|---|---|---|
| 2165433 | 9/1972 | Fed. Rep. of Germany | 162/125 |
| 2041030 | 9/1980 | United Kingdom | 162/123 |

*Primary Examiner*—Peter Chin

*Attorney, Agent, or Firm*—Cooper & Dunham

[57] ABSTRACT

A method of producing a multi-ply paperboard comprising at least one ply high bulk fibers sandwiched between at least two plies of conventional papermaking fibers. In a preferred embodiment, high bulk fibers characterized by twists, kinks and curls are produced by mechanical deformation without substantial fibrillation or breakage of the fibers, as by dry hammermilling or wet milling of the fibers. An aqueous foam furnish is preferred for laying the ply containing high bulk fibers.

10 Claims, 2 Drawing Sheets

METHOD OF MANUFACTURE OF PAPERBOARD

Figure 1:
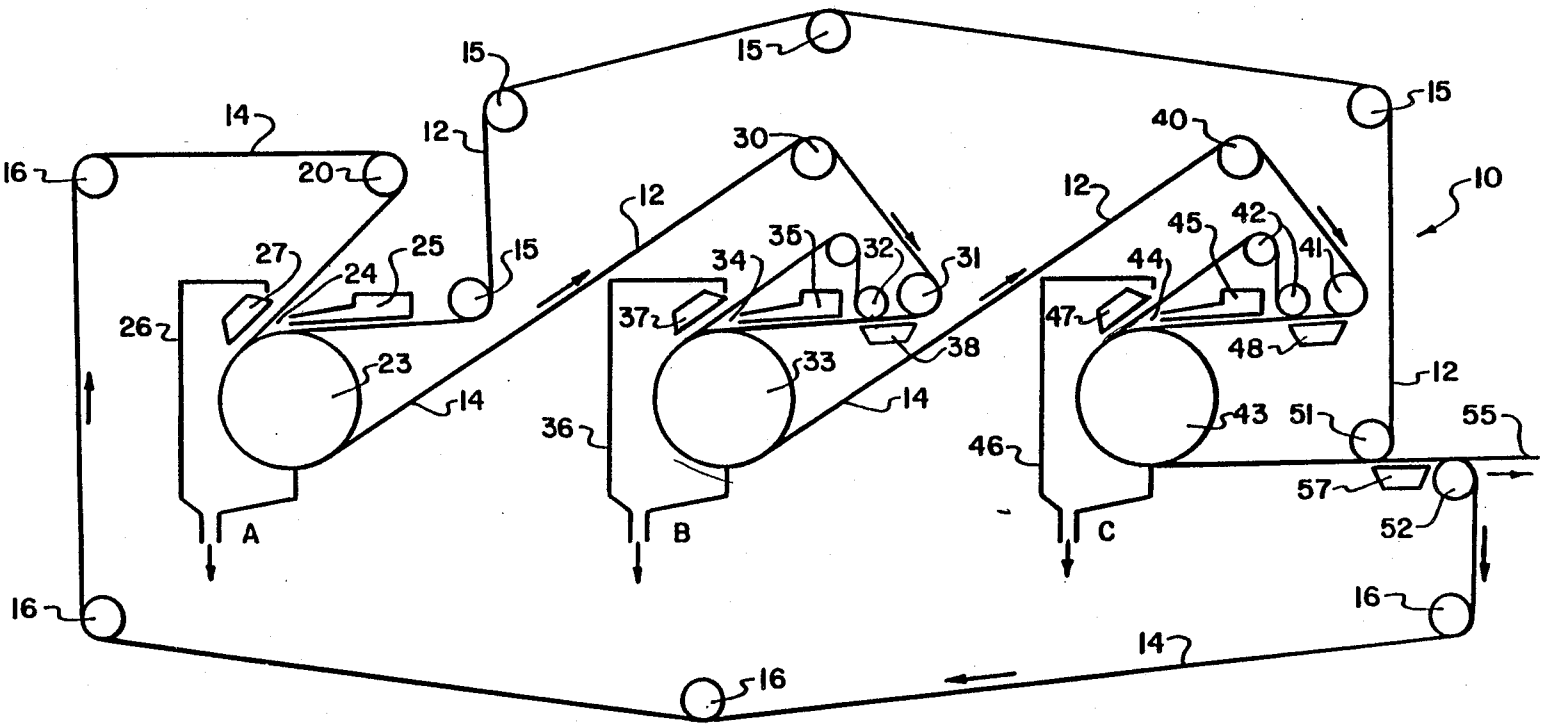

This is a continuation of application Ser. No. 003,200, filed 01-14-87 (now abandoned), which in turn is a continuation of Ser. No. 727,353 filed 04-25-85.

This invention relates to method for the manufacture of a multi-ply paperboard mat, and to an improved multi-ply paperboard mat having premium fiber outer plies and an interior ply of high bulk fibers. The high bulk fibers are preferably hammermilled fibers that are kinked and curled and which are dispensed from a foam furnish to preserve their bulking characteristics.

Multi-ply paperboard mats are commonly prepared from one or more aqueous slurries of cellulosic fibers concurrently or sequentially laid onto a moving foraminous screen. Conventionally, a first ply is formed by dispensing the aqueous slurry of cellulosic fibers onto a long horizontal fourdrinier wire. Water drains from the slurry through the fourdrinier wire usually aided by application of a vacuum thereunder and additional plies are successively laid on the first and dewatered in similar manner. Alternatively, additional plies may be formed by means of smaller secondary fourdrinier wires situated above primary wire with additional aqueous slurries of cellulosic fibers deposited on each smaller secondary fourdrinier wire. Dewatering of the additional plies laid down on the secondary fourdrinier wires is accomplished by drainage through the wires usually with the aid of vacuum boxes associated with each fourdrinier machine. The additional plies so formed are successively transferred onto the first and succeeding plies to build up a multi-ply mat. After each transfer, consolidation of the plies must be provided to bond the plies into a consolidated multi-ply mat.

In order to increase stiffness of a multi-ply paperboard mat, which is a most significant property of paperboard when used for folding carton applications, an increase in basis weight is normally required. An increase in basis weight, in turn, requires an increase in the amount of material used in the paperboard and also an increase in the energy required to dry the paperboard mat.

We have now found that a multi-ply paperboard may be produced from cellulosic fibers with a reduction in the basis weight for paperboard having a given stiffness. Alternatively, it is now possible to produce a paperboard of a given basis weight having improved stiffness as compared with conventionally produced paperboards of the same basis weight.

By the process of our invention, an improved paperboard, as described herein, is produced by forming a mat in which at least one layer, preferably an inner layer of a multiply paperboard mat, is made up of a fiber furnish consisting essentially of kinked and curled cellulosic fibers as more fully described hereinafter.

Kinked and curled fibers, as distinguished from conventional cellulosic fibers, are known, per se, in the prior art. These fibers, also referred to as anfractuous fibers, may be prepared by various known methods, for example by the methods disclosed in U.S. Pat. No. 2,516,384 to Hill; U.S. Pat. No. 2,561,013 to Coghill et al.; U.S. Pat. No. 4,036,679 to Back et al.; U.S. Pat. No. 3,596,840 to Blomqvist et al.; U.S. Pat. No. 3,802,630 to Lee et al.; and U.S. Pat. No. 4,227,964 to Kerr et al., all of which are incorporated herein by reference.

The kinked and curled (anfractuous) fibers have been found to be excellent bulking agents in the manufacture of both wet laid and dry laid tissue webs, imparting softness and improved absorbency to towels and tissues into which they are incorporated. We are not aware of their use heretofore in paperboard products where neither softness nor liquid absorbence are desirable.

The method and apparatus employed of our invention will be more fully understood with reference to the accompanying drawings.

FIG. 1 of the drawings is a diagrammatic illustration of an apparatus suitable for carrying out the process of this invention.

Figure 2:
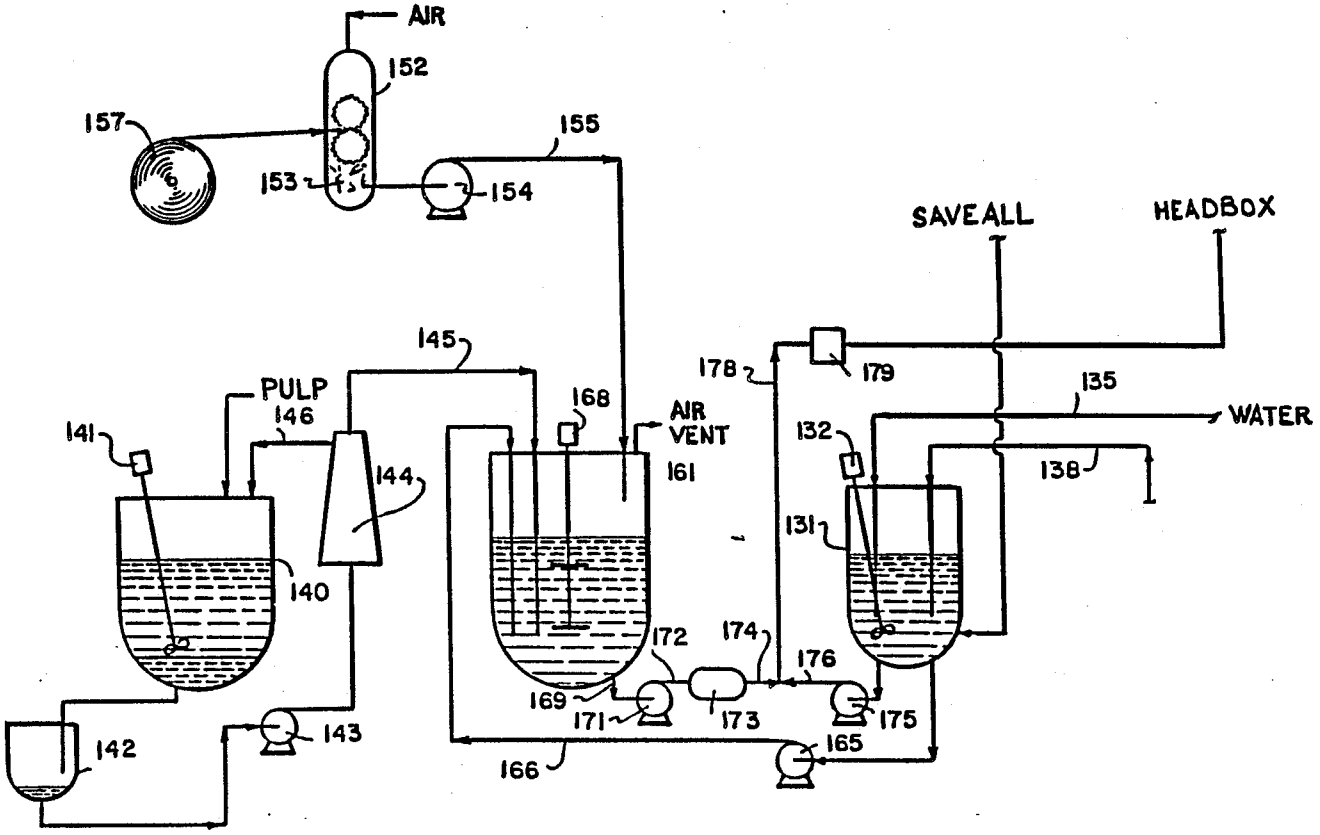

FIG. 2, is a flow diagram illustrating diagrammatically a preferred process by which a dispersion of kinked and curled fibers and an aqueous foam is prepared for production of paperboard in the apparatus illustrated in FIG. 1.

In the production of paperboard by the process of this invention, fibers heretofore used in the manufacture of paperboard may be employed. Typically, conventional fibers are natural cellulosic fibers and include those obtained from wood pulp, cotton, hemp, bagasse, straw, flax and other plant sources, wood pulp being the most common. The wood pulp fibers can be derived from either hardwood or softwood pulps, and generally have fiber lengths ranging from about 1.0 to 6.0 mm. The pulps may be obtained by any of the conventional processes for preparing the fibers, for example, groundwood, cold soda, sulfite, or sulfate pulps, and may be bleached or unbleached.

In carrying out the process of this invention two types of fibers are employed, although the source of the fibers may be identical. That is, the source of the fibers may be any heretofore used in the manufacture of paperboard webs. The first type of fiber is suitably conventional bale pulp papermaking fiber as may be produced by the sulfite, sulfate or other processes. The second type of fiber (treated fiber) is preferably cellulosic fiber characterized by kinks, curls, twists or other intorsions, referred to herein also as treated fibers or anfractuous fibers.

Conventional papermaking fiber is generally suitable for use in the outer plies of a multi-ply paperboard mat giving the mat both strength and a pleasant appearance. Conventional papermaking fibers may be employed also, but to a lesser extent, for the inner higher bulk plies. Characteristically, these fibers are hydrophilic and essentially linear, with a fiber length between about 1.0 and 6.0 mm.

In addition, the conventional fibers may include synthetic fibers such as polyester, polypropylene, polyethylene, polyamide, and nylon fibers, as well as chemically modified cellulosic fibers such as rayon, cellulose acetate, and other cellulose ester fibers.

The treated fiber or anfractuous fiber is also hydrophilic and is preferred for use to produce the inner ply of a multi-ply paperboard mat in accordance with our invention. The combination of an inner ply containing curled and kinked fibers with one or more outer plies of conventional composition result in increased stiffness and minimal basis weight desired by the papermaking industry. Although the length of the preferred treated cellulosic fiber in a relaxed state may also be about 1.0 to 6.0 mm, the length in the compressed or deformed state is considerably reduced. The plurality of intorsions present among the treated fibers provides the fibers with three dimensional characteristics not present in the first type of fiber. The treated fibers are randomly distributed three dimensionally within the finished ply, resulting in a product having increased stiffness without increase in basis weight.

Stiffness is a most significant property of paperboard when used for folding carton applications. The most rigid substrate per unit of weight is a multi-ply or sandwich type construction consisting of two outer skins having high tensile strengths in the X and Y directions and a high bulk center core with high Z direction (compressive) strength. The rigidity of a sandwich structure is proportional to the cube power of the thickness of the structure, which, in turn, indicates that a thick core is desirable. On the other hand, a balance must be struck between strength and cost of the structure. Multi-ply forming provides the means for selectively incorporating the most desired characteristics in each ply, i.e., high tensile strength in the outer skins and a high bulk core with high Z-direction compressive and tensile (fiber-bond) strength. The plies must be bonded together well enough to resist shear stress when under load and provide Z-direction fiberbond strength within and between plies to resist splitting during converting and end use.

In accordance with this invention, the core structure of a multi-ply paperboard is made up essentially of treated (anfractuous) cellulosic fibers. While any of the various known means of producing anfractuous cellulosic fibers may be employed, including chemical treatment and combinations of mechanical and chemical treatments, e.g., wet or dry milling followed by caustic treatment, a preferred method of preparing the treated fibers is that disclosed in co-pending co-assigned patent application, Ser. No. 409,055 filed Aug. 18, 1982.

It is a characteristic of mechanically treated fibers that they do not become permanently kinked from the mechanical treatment. As the treated cellulosic fibers are hydrophilic, they tend to return to their original shape in a relatively short period of time after they are wet with water or slurried in an aqueous medium. The rate of relaxation of the relatively short-lived intorsions is most rapid during the first few minutes after they are wet with water. Generally the intorsions relax considerably with about 1 to about 10 minutes in a water environment. On the other hand, chemically kinked cellulosic fibers, e.g. fibers treated with ammonia or caustic, tend to retain their intorsions for longer periods of time and are less subject to relaxation in an aqueous environment.

It is a requisite that the means used to prepare the fibers not fibrillate them to any substantial degree, the presence of fibrils being antithetical to the bulk enhancement properties of the fibers. A preferred method for preparing the treated fibers is to defiberize dry laps of treatable fibers in a hammermill. The term "dry" means that no free water is present in the fibers, although the laps, bales or the like will normally contain as much as about 15% equilibrium moisture by weight as a result of storage under atmospheric conditions. The average residence time of the fibers in the hammermill is preferably less than about one second, thus providing a rapid method and means of preparation, which method may easily process between 100 and 500 pounds of treatable fibers per hour per hammermill. Leaving the hammermill, the moisture content of the fibers is about 1 to 5% by weight, and is essentially a function of the equilibrium moisture content of the particular fiber at the mill temperature.

As an alternate to hammermilling, mechanically kinked fibers may be produced by wet milling in a disk refiner.

In a preferred embodiment, dry treated fibers are added to water or to a foamed aqueous liquid carrier comprising air, water and surfactant to make up the furnish for the core of the structure of this invention. A preferred method for making a foamed fiber furnish is described in U.S. Pat. No. 4,443,297, Cheshire et al., incorporated herein by reference.

In a multi-ply paperboard mat, the basis weight of each ply is limited to an anticipated maximum of about 150 pounds per ream (3,000 square feet). This limitation is apparently due to the difficulty in removing the water or foam from the ply through the forming wire. Lower basis weights, in the range of 75 to 125 pounds per ream, are preferred because better formation of the individual plies is obtained apparently due to improved dewatering of the plies. Maximum allowable basis weight is also related to the type of fibers laid, certain fibers being less susceptible to dewatering than others. For example, when employing chemical pulp fibers for ply formation, a maximum basis weight at the low end of the aforesaid range is preferred, say about 85 pounds per ream, primarily because these fibers are ribbon-like and lie in a single plane of the ply. Hence, plies from such chemical fibers typically have fewer voids, and dewatering of the ply is more difficult. On the other hand, mechanically treated fibers, including thermomechanical pulp and dry hammer-milled fibers, form more porous plies which can be more easily dewatered, and are useful for laying plies having a maximum basis weight at the high end of the range, say about 125 pounds per ream. In one preferred embodiment, the outer plies of a multi-ply paperboard are formed from conventional fibers in water slurries and the inner ply is formed from treated fibers in a foam dispersion. The presence of the surfactant in the foam type furnish tends to reduce drainage capability as the weight of fibers laid increases. Because of the competing effects of bonding and fiber content and basis weight on drainage, it is to be understood that optimization of these parameters as well as choice of foam or slurry furnishes are best determined by preliminary tests.

Typically, each outer ply of the mat constitutes between about 10 and 25% of the total basis weight of the mat, although this restraint is not critical. Thus, for example, a three ply 150 pound per ream mat may have an inner ply of between about 75 to 125 pounds per ream, and two outer plys of between about 15 to 37.5 pounds per ream per ply. For high basis weight mats, say over 200 pounds per ream, two or more inner plies may be used. In low basis weight mats, the outer plies preferably have a basis weight of at least about 15 pounds per ream, the percentage of basis weight represented by the outer plies being greater than for higher basis weight mats.

One distinct advantage obtained by the method disclosed herein is that the separate plies of the multi-ply mats can attain a high degree of bonding at each ply interface through the development of hydrogen bonds. This occurs because each successive ply is laid adjacent a preceding ply which generally has between about 75 to about 93 weight percent residual moisture. Not only does this moisture level ensure interfiber bonding between plies, it also allows some fiber migration from one ply to another. Hence, the composite mat resists ply separation which is prevalent in mats whose plys have been "laminated" together in a less wet state by compression between consolidated rolls.

However with certain multi-ply webs a bonding agent may be required to ensure adequate bonding and increase stiffness. Suitable bonding agents include cationic starch; polyvinyl alcohol; pearly starch; natural gums (tragacanth, karaya, guar); natural and synthetic latex, including polyacrylates, e.g. polyethlacrylate, and copolymers; vinyl acetate-acrylic acid copolymers; polyvinyl acetates; polyvinyl chlorides; ethylene-vinyl acetates; styrenebutadiene carboxylates; polyacrylonitriles; and thermosetting cationic resins, e.g. urea formaldehyde resins and polyamide-epichlorhydrin resins as disclosed in U.S. Pat. No. 3,819,470. Bonding materials are desirable where the conventional fibers used in the web are not self-bonding, as in certain synthetic and chemically modified cellulosic fibers.

It has also been found that the addition of about 10% by weight polyvinyl acetate fiber with dry cellulosic fiber eliminates the need for internal starch and increases cellulosic fiberbond.

The addition of 1 weight percent starch to a 100% treated fiber results in a multi-ply paperboard mat with adequate bonding of the plies. The starch solution may be injected into the furnish from a multi-slice headbox in the center of the stock so the starch solution provides a middle layer in the forming zone. Viscosity and concentration of the starch solution should be adjusted to allow outward flow of the starch solution with a minimum loss through wire. This provides a uniform dispersion of starch on the fibers during drainage, alleviates delamination problems and provides controllable and uniform bonding of the fibers.

Referring to FIG. 1, a means of producing a multi-ply paperboard mat of increased stiffness is illustrated the forming apparatus designated generally by numeral 10. Two endless foraminous forming wires 12, 14 are used with the apparatus, and are situated on a plurality of guide rolls (described individually hereinafter) which guide their paths through the apparatus. Mat 55 formed by the three stations of the apparatus 10 is made up of an inner ply sandwiched between two outer plies, but additional forming stations may be included if more plies are desired. Beginning at the first ply forming location A at the left, wire 12, returning from the last forming location C, is directed around guide rolls 15 and about solid forming roll 23 in direct communication therewith. Similarly, wire 14 proceeds around guide rolls 16 and 20, and is directed obliquely about the forming roll 23. The wire 14 is superposed on the wire 12 in such a manner as to form a nip 24 at their point of convergence. Furnish is dispensed into nip 24 from headbox 25. As the wires 12, 14 proceed about the roll 23, the fibers are uniformly pressed between the wires, water being ejected through the perforations of the exterior wire 14 and into saveall 26. Vacuum box 27 optionally may be used to improve dewatering and assist in the production of the higher basis weight plies.

The thus formed first ply is carried between the wires 12, 14 and around guide rolls 30, 31, said wires 12, 14 being separated thereafter by guide rolls 32. It is preferred that the initially formed ply be retained on the wire which will be in contact with the next forming roll 33, in this case, wire 12. As with ply forming location A, the wires are again directed about a forming roll, roll 33, which form a nip 34 at their convergence. Vacuum box 38 can be installed to provide a vacuum of between about 1 to about 25 inches of mercury below the wire 12, and vacuum box 37 also may be provided to assist in dewatering.

It is preferred that furnish dispensed from headbox 35 be deposited so that the ply thus formed is laid between the first ply and the wire through which most of the water is removed, in this case, wire 14. By providing this arrangement, water is removed directly from the ply, and does not have to pass through an existing ply. Hence, a greater degree of dewatering can be obtained. Conversely, plies of higher basis weight can be laid at a given dewatering rate. As additional plies are added, or as the basis weight of the plies increase, this requirement becomes increasingly important. Of course, this feature is preferably incorporated at each of the forming locations B and C, or other forming locations as may be included.

After pressing of the two ply mat about forming roll 33, water being removed through saveall 36, the wires are guided about rolls 40, 41 in superposed relation and then to forming location C of like design comprising guide rolls 42 for separating the wires 12, 14, forming roll 43, headbox 45 dispensing furnish to nip 44, saveall 46, and optionally vacuum boxes 47, 48. From roll 43, the superposed wires carrying the mat sandwiched therebetween travel to guide roll 51 where wire 12 is separated from mat 55 assisted by vacuum box 57, and returns via guide roll 15 to location A. The mat 55 is transferred from forming wire 14, to a carrier wire (not shown) for further downstream processing. Wire 14 separated from the mat by guide roll 52 returns via guide rolls 16 to location A. Any number of ply-forming locations can be incorporated in the apparatus 10 depending on how many plies are desired. However, conventional paperboard products typically have between 3 and 5 plies.

Referring now to FIG. 2 which is a flow diagram showing process by which a foam, treated fiber furnish is produced and transported to a headbox, such as headbox 35 of FIG. 1, to produce an interior ply of enhanced stiffness, of a multi-ply paperboard mat. A pulp of untreated fiber is prepared conventionally in pulp tank 140, the consistency thereof being about 1.0 to 4.0% fiber by weight. A well mixed dispersion of the fiber is obtained by high shear agitator means 141.

Typically, the slush pulp is stored in a machine chest 142 to provide a readily available supply of pulp. The slush pulp is withdrawn from tank 140 (or from the machine chest, if used) by pump 143 and is directed to a stock press 144. Leaving the stock press 144 through line 145, the pulp has a consistency sufficient to require the addition of make-up water and surfactant solution to the closed loop foam system via lines 135 and 138 respectively. A suitable stock press is available from Arus-Andritz. The consistencey of the pulp in line 145 can be calculated easily by material balance. In general, however, the consistency is between 8 and 50 weight percent, preferably between 15 and 35 weight percent. Water removed from press 144 is recycled to the tank 140 through line 146, while the high consistency pulp of line 145 is introduced to the mix tank 161 well below the liquid level therein. It is, of course, apparent that where webs of 100% treated fiber are to be made, the above described pulping or repulping procedures are not required.

Concurrently with the preparation of untreated fibers, treated fibers are prepared for introduction into mix tank 161. In the preferred embodiment, untreated pulp laps or bales 157 are defiberized in a hammermill 152 in a manner so as not to substantially create fibrillation of the fibers as mentioned above. Individual fibers 153, now having the anfractuous characteristics hereinbefore described, are transported pneumatically in duct 155 via blower 154 to mix tank 161, wherein the dry fibers are added above the liquid level therein. Transport air is withdrawn from tank 161 through the air vent.

Foamed liquid from the silo 131 is transferred by pump 165 through line 166 to tank 161. Pump 165 is of the twin screw type or moyno type capable of transferring low density liquids such as the foamed liquid. The volume of foamed liquid thus transfereed is that amount necessary to obtain a mix tank consistency of between about 0.3 to about 4 weight percent. An agitator 168 provides the requisite energy to disperse the fibers rapidly, but gently such that wetting of the treated fibers is minimized. The foamed furnish of treated and untreated fibers leaves the mix tank 161 by line 169, a moyno or twin screw pump 171 providing the motive energy therefor. The discharge from pump 171, line 172, is directed to a deflaker 173, which is a very low residence time, high shear device capable of breaking apart bundle or clump of fibers that may exist, and which would ultimately compromise the formation quality of the web ply.

In the preferred embodiment, that is, where the mix tank consistency is between 1.5 to 4% fiber by weight, additional foamed liquid is pumped from the silo 131 by twin screw pump 175 through line 176, and is combined with the deflaker discharge, line 174, the combined streams 178 being introduced to the headbox (not shown). Screen 179 is provided in line 178 to remove debris therefrom, which debris may cause mechanical problems in downstream equipment as well as poor product. The flow rate in line 176 is such that the furnish of line 174 is further diluted to a final (headbox) consistency of between about 0.3 to about 1.2% by weight. Where the mix tank consistency is less than 1.2% fiber by weight, further dilution is not required.

The plies containing treated fibers are preferably manufactured by the process disclosed herein and comprise at least 10% by weight of the treated fibers, described previously, the remaining fibers making up the web being the aforesaid conventional fibers. Preferably the weight ratio of treated fibers to conventional fibers in the ply is in the range of 3:1 to 1:3. The plies may range in basis weight from 8 to 125 pounds per ream.

EXAMPLE 1

Tests were made to show the effects of low density and high density pulps on stiffness of 160 pound per ream (3000 square feet) single and multi-ply sheets. Two pulps were used in these tests. The first, termed SBS pulp, is a blend of 65 weight percent hardwood Kraft fibers and 35 weight percent softwood Kraft fibers refined to 525 CSF. The other, termed TMP pulp, is made up of a high bulk fiber manufactured and sold by Weyerhaeuser Company under the trade name ECO-FLUFF TMP, refined to 500 CSF.

Single and multi-ply test sheets, each having a basis weight of 160 pounds per ream (3000 square feet) were prepared for comparative test purposes. Results are shown in Table I, below. In Run 1, a single ply sheet was made up entirely of SBS pulp. In Run 2, a three ply sheet was prepared entirely from SBS pulp and comprising a 100 pound basis weight central ply and two 30 pound external plies. In Run 3, a single ply sheet was made up entirely of TMP while in Run 4, the sheet comprised two plies, one of 100 pound basis weight TMP and the other, 60 pound SBS. Finally, in Run 5, a three ply sheet was prepared with a central ply of 100 pound TMP and two external 30 pound plies of SBS.

TABLE I

| WATER FORMED PAPERBOARD | | | | |
|---|---|---|---|---|
| RUN NO. | NO. OF PLIES | BASIS WT. (3000 FT.$^2$) | DENSITY B.WT./CAL. | TABER STIFFNESS |
| 1 | 1 | 160 | 9.7 | 83 |
| 2 | 3 | 160 | 9.7 | 85 |
| 3 | 1 | 160 | 6.0 | 110 |
| 4 | 2 | 160 | 7.1 | 105 |
| 5 | 3 | 160 | 7.1 | 140 |

A comparison of Runs 1 and 2 indicates that no improvement in stiffness is obtained in a multi-ply sheet as compared with a single ply sheet of the same total basis weight when the plies are all made up from the same pulp.

In a single ply configuration, the higher bulk pulp produces a stiffer board product (Run 1 compared with Run 3) which is degraded slightly in a two ply sheet combining a 60 pound ply of SBS with a 100 pound ply of TMP (Run 4). Finally, much greater stiffness results when the 100 pound ply of TMP is sandwiched between two 30 pound plies of SBS (Run 5 compared with Runs 3 and 4).

EXAMPLE 2

Test handsheets were prepared with a nominal basis weight of 160 pounds per ream by foam forming using SBS and hammermilled anfractuous fibers in accordance with the present invention. In Run 6, a single ply was made up entirely of SBS pulp dispersed in water. In Run 7, the handsheets were foam formed entirely from hammermilled fibers added to foam as described in the above description of FIG. 2 of the drawings. In Run 8, three ply handsheets were formed from a foam dispersion as in Run 7, with a center ply of anfractuous hammermilled fibers and two 13.5 basis weight external plies of SBS pulp. SBS pulp is described in Example 1. Results are shown in the following Table II.

TABLE II

| FOAM FORMED PAPERBOARD | | | | |
|---|---|---|---|---|
| RUN NO. | NO. OF PLIES | BASIS WT. (3000 FT.$^2$) | DENSITY B.WT./CAL. | TABER STIFFNESS |
| 6* | 1 | 160 | 9.7 | 85 |
| 7 | 1 | 160 | 6.7 | 95 |
| 8 | 3 | 160 | 7.1 | 175 |

*water laid

As will be evident from the above table, foam forming results in improved stiffness of the paperboard as compared with water laid paperboard (Run 7 compared with Run 6) anfractuous fibers sandwiched between plies of conventional fibers produced a product having much greater stiffness than paperboard made entirely of either type fiber alone (Run 8 compared with Runs 6 and 7).

Taber stiffness, fiberbond, and CSF (Canadian Standard Freeness) are TAPPI tests used by the paper industry. The TAPPI reference numbers for these tests are: Taber Stiffness—TAPPI Standard Method T-489, Fiberbond—TAPPI Useful Method UM-528, and Canadian Standard Freeness (CSF)—TAPPI Standard Method T-227.

It is evident from data reported in Tables I and II that superior strength paperboard from a given weight of fiber is produced when a multiply board is made up with anfractuous fibers sandwiched between conventional fibers.

We claim:

1. A method of making a stiff three-ply paperboard which is substantially stiffer than three-ply paperboard of the same basis weight in which the middle ply has the same degree of fiber convolution as the outer ply, comprising the steps of:

(a) preparing a conventional cellulosic papermaking fiber furnish in an aqueous carrier fluid in which the fibers are not highly convoluted;

(b) preparing a treated papermaking fiber furnish in an aqueous carrier fluid in which the fibers differ from those in said conventional cellulosic papermaking fiber furnish by being characterized by twists, kinks and curls without substantial fibrillation or breakage of the fibers;

(c) dispensing conventional fiber furnish onto a web-forming foraminous support where aqueous carrier fluid is drained from the dispensed conventional fiber furnish forming therefrom a first outer ply in which the fibers are not highly convoluted;

(d) dispensing treated fiber furnish onto said first outer ply on said forming support forming therefrom a middle ply in which the fibers are highly convoluted and which is intimately bonded to said first outer ply to resist delamination therefrom;

(e) dispensing conventional fiber furnish onto said middle ply on said forming support forming a second outer ply in which the fibers are not highly convoluted and which is intimately bonded to said middle ply to resist delamination thereof; and (f) dewatering the resulting three-ply paperboard said paperboard to thereby provide a stiff three-ply paperboard which is substantially stiffer than three-ply paperboard of the same basis weight in which the middle ply has the same degree of fiber convolution as the outer ply.

2. The method of claim 1 wherein at least one of said conventional fiber furnish in an aqueous carrier fluid and said treated fiber furnish in an aqueous carrier fluid contains between 0.001 percent and 5 percent by weight of a bonding aid.

3. The method of claim 2 wherein said bonding aid is selected from the group consisting of starch, dry strength resins, alginate and carboxymethylcellulose.

4. The method of claim 1 wherein said treated paper-making fiber furnish comprises a mixture of treated fibers and conventional paper-making fibers wherein the treated fibers comprise at least 10 percent by weight of all fibers present in said treated paper-making fiber furnish.

5. A stiff three-ply paperboard which is substantially stiffer than paper toweling or tissue and has substantially greater stiffness than three-ply paperboard of the same basis weight in which the middle ply has about the same degree of fiber convolution as the outer plies, comprising a middle ply of high bulk fibers consisting essentially of highly convoluted paper-making fibers and two outer plies which are intimately bonded to the middle ply and which consist essentially of conventional papermaking fibers which are not highly convoluted as compared with the convoluted fibers of the middle ply.

6. The multi-ply paperboard of claim 5 wherein said high bulk fibers are produced by subjecting hydrophilic papermaking fibers to mechanical deformation without substantial fibrillation or breakage of the fibers and characterized by twists, kinks and curls and the ability to retain their characteristic shapes for only a relatively short period of time when wet with water.

7. Three-ply paperboard as defined in claim 5 having a composite basis weight in the range of 50 to 400 pounds per 3000 square feet in which the basis weight of each ply is within the range of 10 to 150 pounds per 3000 square feet.

8. Three-ply paperboard as defined in claim 7 wherein the basis weight of each outer ply of said stiff paper-board is about 0.3 the basis weight of the middle ply.

9. Three-ply paperboard as defined in claim 8 wherein the Taber Stiffness said stiff paperboard is at least 60 percent higher than that of paperboard made up of said conventional fibers.

10. Three-ply paperboard having a basis weight of about 160 pounds per 3000 square feet wherein the middle ply has a basis weight of about 100 pounds per 3000 square feet and the outer plies each have a basis weight of about 30 pounds per 3000 square feet and the Taber Stiffness of said stiff paperboard is in the range of from about 140 to about 175.

* * * * *